US005725191A

United States Patent [19]

Nemeth

[11] Patent Number: 5,725,191

[45] Date of Patent: Mar. 10, 1998

[54] NOTEBOOK COMPUTER COPY CLIP

[75] Inventor: Bradley M. Nemeth, Oak Ridge, Tenn.

[73] Assignee: Brauner-Nemeth, Inc., Palo Alto, Calif.

[21] Appl. No.: 773,576

[22] Filed: Dec. 27, 1996

[51] Int. Cl.[6] ..... B41J 11/02

[52] U.S. Cl. ..... 248/442.2; 248/441.1; 248/451; 248/453; 248/918; 24/67.11; 24/336; 24/531

[58] Field of Search ..... 248/442.2, 441.1, 248/918, 451, 453; 24/336, 530, 531, 67.11

[56] References Cited

U.S. PATENT DOCUMENTS

| | | | |
|---|---|---|---|
| 4,836,489 | 6/1989 | Chu | 248/442.2 |
| 5,044,593 | 9/1991 | Jones | 248/442.2 |
| 5,104,088 | 4/1992 | Bakanowsky, III | 248/442.2 |
| 5,161,767 | 11/1992 | Hansen | 248/447.1 |
| 5,301,915 | 4/1994 | Bahniuk et al. | 248/452 |
| 5,328,145 | 7/1994 | Charapich | 248/442.2 |
| 5,383,642 | 1/1995 | Strassberg | 248/442.2 |
| 5,398,905 | 3/1995 | Hinson | 248/442.2 |
| 5,533,702 | 7/1996 | Koch | 248/442.2 |
| 5,549,268 | 8/1996 | Hopwood | 248/442.2 |

*Primary Examiner*—Derek J. Berger
*Assistant Examiner*—Donald J. Wallace
*Attorney, Agent, or Firm*—Pitts & Brittian, P.C.

[57] ABSTRACT

A notebook computer copy clip for being removably secured to either side or the top of the screen of a notebook computer for holding documents for viewing while using the computer. The copy clip of the includes a spring member and a facia member, each being fabricated from a flexible, resilient material such that the copy clip may be bent to engage a side or the top of a notebook computer screen, and such that when removed, it will return to a planar disposition. To this extent, each of the spring member and the facia member defines a substantially planar configuration. An engagement device is provided for securing the facia member to the spring member. The engagement device includes cooperating engagement tabs and tab receptors defined by the spring member and the facia member. In order to lock the engagement of the facia member with the spring member, the spring member defines a locking member below the engagement tab thereof for engaging the lower extent of the facia member tab receptor. In order to prevent damage to the notebook computer housing, cushions may be carried on the outer tabs of the spring member and the central tab of the facia member. In order to provide a limit for paper placed within the copy clip, and for aligning the paper within the copy clip, the spring member may define raised portions at each end of the first side thereof.

11 Claims, 6 Drawing Sheets

NOTEBOOK COMPUTER COPY CLIP

TECHNICAL FIELD

This invention relates to the field of copy holders. More specifically, the present invention relates to a device for holding documents relative to a notebook, or laptop, computer such that the user of the computer may view the documents while typing.

BACKGROUND ART

In the field of computers, it is well known that notebook computers are quickly gaining popularity in that the costs associated therewith are dramatically reducing while the utility is ever increasing. Many people use notebook computers while traveling, especially in airports, on airplanes, and in hotel rooms. However, it is well known that many common uses for a notebook computer do not lend themselves to appropriate environments for placement of documents for viewing while typing. Typical in an office setting is a copy stand either mounted on a computer monitor, or placed upon a desk top in similar fashion to an easel.

Many various devices have been produced to hold copy relative to a computer monitor such as used with a desktop computer. Typical of the art are those devices disclosed in the following U.S. patents:

| U.S. Pat. No. | Inventor(s) | Issue Date |
|---|---|---|
| 4,836,489 | C. Chu | June 6, 1989 |
| 5,044,593 | H. J. Jones | Sept. 4, 1991 |
| 5,104,088 | L. J. Bakanowsky, III | Apr. 14, 1992 |
| 5,161,767 | P. R. Hansen | Nov. 10, 1992 |
| 5,301,915 | D. E. Bahniuk, et al. | Apr. 12, 1994 |
| 5,328,145 | D. R. Charapich | July 12, 1994 |
| 5,383,642 | G. Strassberg | Jan. 24, 1995 |
| 5,398,905 | L. A. Hinson | Mar. 21, 1995 |
| 5,533,702 | R. C. Koch | July 9, 1996 |
| 5,549,268 | J. J. Hopwood | Aug. 27, 1996 |

Of these patents, those devices disclosed by Chu ('489), Jones, ('593), Bakanowsky, III ('088), Hansen ('767), Bahniuk, et al. ('915), and Hinson ('905) are each provided for being mounted on a computer monitor associated with a desk top computer. Each of these devices is mounted on the computer monitor using either an adhesive, an adhesive tape, or a hook-and-loop fastener, a portion of which is adhered to the monitor. Although these devices could be adapted to be used with the screen of a notebook computer, only those embodiments using hook-and-loop fasteners could be adapted due to the intended permanency of the adhesives and adhesive tapes. However, due to the size constraints of a notebook computer in order to accomplish portability, the particular configurations of each of these devices makes their use prohibitive. Further, even with the use of a hook-and-loop fastener, once a portion of the hook-and-loop fastener has been fixed to the computer, it is intended to remain in place, thereby limiting the disposition of the holding device and altering the computer itself.

Charapich ('145) and Strassberg ('642) both disclose devices for non-permanent securement to a computer monitor associated with a desk top computer. However, each of these devices is limited to a particular disposition of the holder with respect to the monitor. Specifically, Charapich discloses a mounting board having an opening defined for viewing the monitor screen therethrough. A clamp is carried to one side of the mounting board for holding copy. The Charapich device is not reversible such that documents may be held on either side of the monitor, nor does it allow for the disposition of documents above the monitor. The Strassberg device includes a mounting bracket that is carried on the top of the monitor and held in position by a clamp. A copy holder is disposed on both sides of the bracket, with a third on the top. However, such a device in not practical in situations where space is critical. For example, while using a notebook computer on an airplane, one may require that the copy be held above the computer, while holding copy to either the left or right would interfere with the comfort of those seated next to the user. Further, as in the previously discussed devices, the size and construction of the Charapich and Strassberg devices make their use prohibitive with a notebook computer.

Those devices disclosed by Hopwood ('268) and Koch ('702) are provided for holding copy on the screen of a notebook computer. The device disclosed by Hopwood is a flexible elongated member having a clip disposed at each end. One clip is mounted to the side of the notebook computer and the other clip is provided for holding copy. The flexible member is deformed such that the copy is disposed at the proper location for viewing. It is not apparent from the disclosure that the device can be manipulated in order to hold copy above the screen.

The device disclosed by Koch is a leaf-spring type device offering many advantages over the previously discussed prior art. Specifically, such a device may be disposed on either side or the top of the notebook computer screen. Non-permanent devices are used for securing the device to the computer. Upon removal of the device from the computer, no alteration of the computer has been made, and the device returns to a flat disposition, thereby allowing it to be stored in the carrying case with the notebook computer. However, such a configuration is not without its deficiencies. Specifically, when the device is mounted on a notebook computer, the projection provided for securing the document to the device is disposed at a point farthest back from the computer screen. This is required in order to hold the document. However, because the projection is defined within an opening as illustrated and described, the projection necessarily wrinkles the document being held. This was the result in the development stages of the present invention, when an embodiment similar to the Koch device was developed and tested. Another deficiency in the Koch device is the inability to hold and maintain the position of several sheets of paper at one time, as the vibration of the computer during typing will cause the paper to eventually fall.

None of the above-mentioned prior art discloses a device for holding documents relative to the screen of a notebook computer, whereby no element of the device must be permanently affixed to the computer, whereby the documents held by the device are not damaged, and whereby the documents are firmly held.

Therefore, it is an object of this invention to provide a means for holding copy on a notebook computer.

Another object of the present invention is to provide such a device which can be alternately mounted on either side or the top of the notebook computer screen.

Still another object of the present invention is to provide such a device which can be mounted on the notebook computer screen without requiring any permanent modification of the notebook computer housing.

Yet another object of the present invention is to provide such a device whereby documents held thereby are maintained in their original condition, without requiring wrinkling thereof.

DISCLOSURE OF THE INVENTION

Other objects and advantages will be accomplished by the present invention which serves to be removably secured to the screen of a notebook computer for holding documents for viewing while using the computer. Moreover, in the preferred embodiment the copy clip is designed to be usable with a notebook computer on either side or the top of the screen. Further, the copy clip is designed such that documents retained thereby are not damaged while being retained.

The copy clip of the present invention is comprised primarily of a spring member and a facia member. The spring member is fabricated from a flexible, resilient material such that it may be bent to engage a side or the top of a notebook computer screen, and such that when removed, it will return to a planar disposition. To this extent, the spring member defines a substantially planar configuration. The spring member defines a pair of outer tabs, with one each being disposed at either end of the spring member first side. A central tab is defined by the spring member at the central portion of the spring member on the first side thereof. Each of the outer tabs and the central tab extend away from the spring member first side in a substantially parallel fashion, and coplanar to the spring member. The spring member may be bent such that the notebook computer screen is received between the outer and central tabs, with the outer tabs being disposed in front of the screen and the central tab being disposed behind the screen.

The facia member defines a substantially elliptical configuration having opposing wings extending away from a central tab. The facia member is fabricated from a flexible, resilient material similar to the material of fabrication of the spring member. The facia member defines a substantially planar configuration. The facia member defines a central tab substantially similar in size to the spring member central tab. An upwardly extending wing and a downwardly extending wing are each defined by the facia member, each being a substantial mirror image of the other, and each extending away from the central tab as shown. When the spring member is bent such that the notebook computer screen is received between the outer and central tabs, the ends of the wings engage the spring member while the central portion of the facia member is forced away from the central portion of the spring member. Thus, the facia member serves as a leaf spring acting in an opposite direction as that of the spring member. As a result, when a document is inserted between the spring member and the facia member, when the copy clip is disposed on a notebook computer, the ends of the facia member wings are biased toward the spring member to hold the document firmly in place.

In order to secure the facia member to the spring member, an engagement device is provided. Cooperating engagement tabs and tab receptors are defined by the spring member and the facia member such that the spring member and facia member may be loosely secured one to the other. In order to lock the engagement of the facia member with the spring member, the spring member defines a locking member below the engagement tab thereof for engaging the lower extent of the facia member tab receptor.

In order to prevent damage to the notebook computer housing, cushions may be carried on the outer tabs of the spring member and the central tab of the facia member. Each cushion is dimensioned and placed to protect each point of engagement of the copy clip with the notebook computer.

In order to provide a limit for paper placed within the copy clip, the spring member may define raised portions at each end of the first side thereof. The limits serve to prevent documents from being forced into engagement with the notebook computer, and further to assist in aligning the document.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A notebook computer copy clip incorporating various features of the present invention is illustrated generally at 10 in the figures. The notebook computer copy clip, or copy clip 10, is designed for being removably secured to the screen 12 of a notebook computer for holding documents 14 for viewing while using the computer. Moreover, in the preferred embodiment the copy clip 10 is designed to be usable with a notebook computer on either side or the top of the screen 12. Further, the copy clip 10 is designed such that documents 14 retained thereby are not damaged while being retained.

Figure 1:
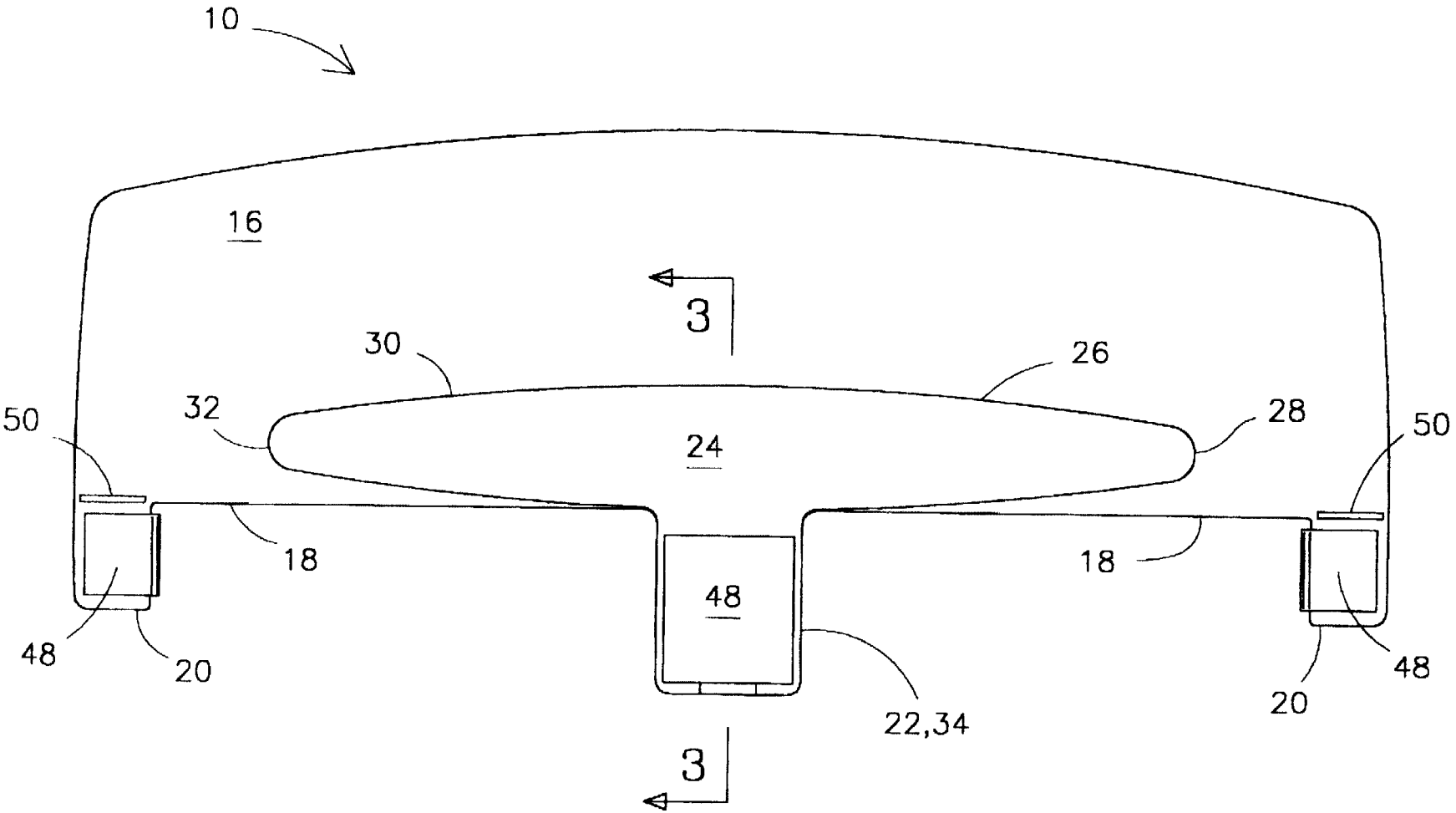
FIG. 1 is a front elevation view of the notebook computer copy clip constructed in accordance with several features of the present invention.
Figure 2:
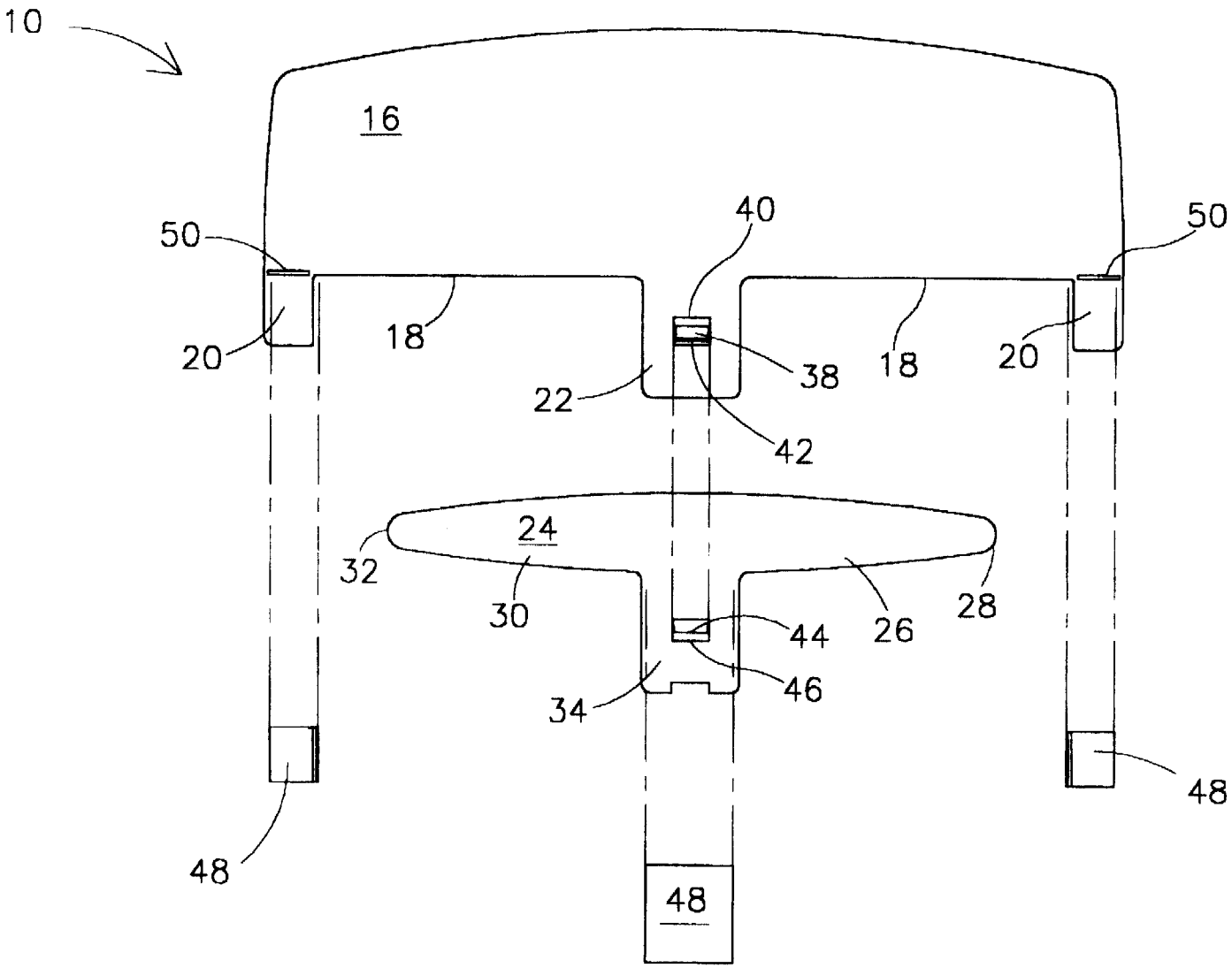
FIG. 2 illustrates an exploded front elevation view of the notebook computer copy clip of FIG. 1.
Figure 4:
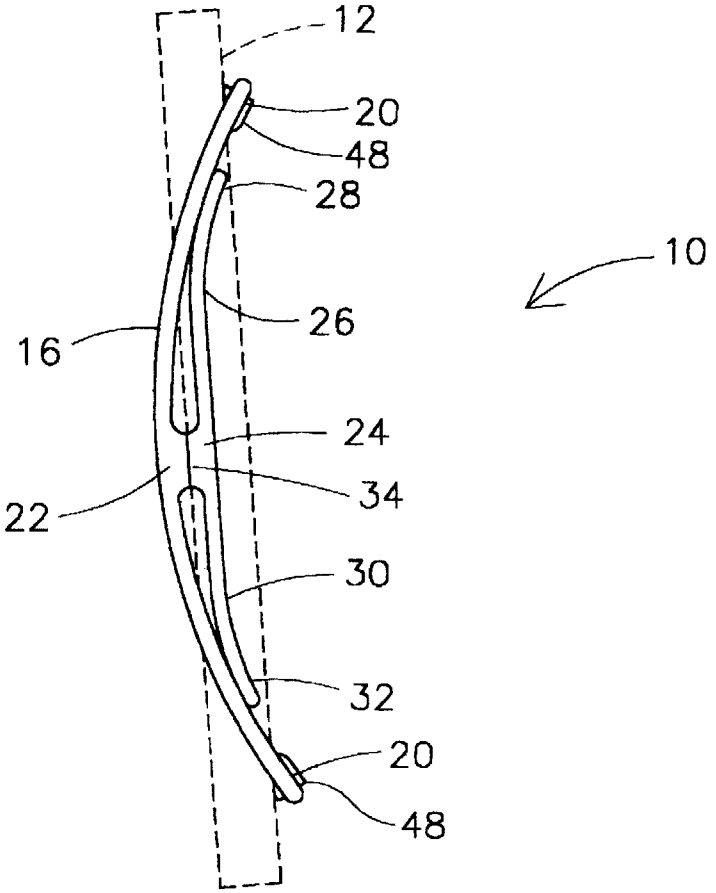
FIG. 4 illustrates an end elevation view of the notebook computer copy clip of FIG. 1 shown being carried on the screen of a notebook computer.
Figure 5:
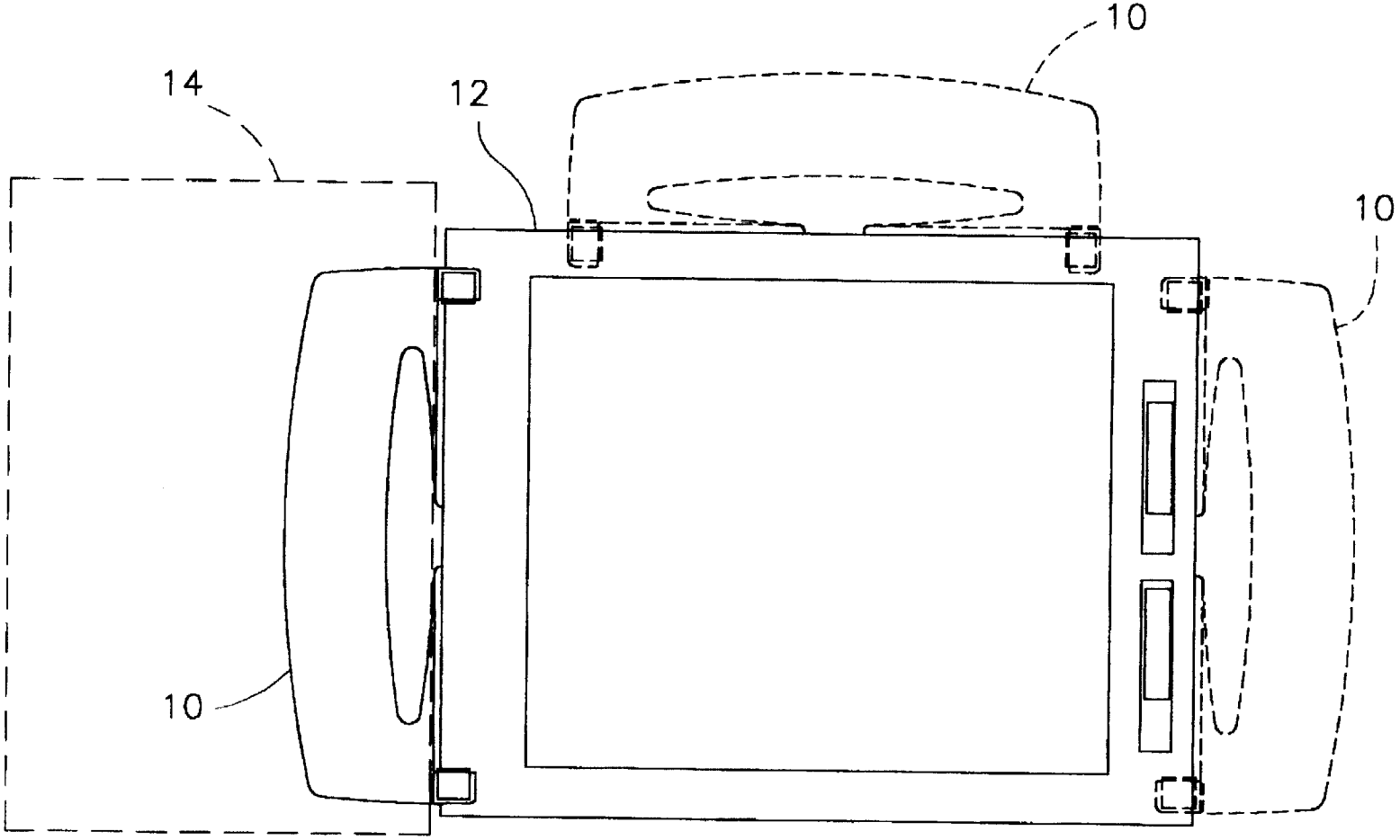
FIG. 5 illustrates a front elevation view of the notebook computer copy clip of FIG. 1 shown being carried on the screen of a notebook computer, with alternate dispositions of the notebook computer copy clip being illustrated with broken lines.

The copy clip 10 of the present invention is comprised primarily of a spring member 16 and a facia member 14. FIG. 1 illustrates the spring member 16 and facia member 24 being secured one to the other, while FIG. 2 illustrates the same view with the two members 16,24 separated. FIG. 2 more clearly illustrates the features of each of the spring and facia members 16,24. The spring member 16 is fabricated from a flexible, resilient material such that it may be bent as illustrated in FIG. 4 to engage a side or the top of a notebook computer screen 12, and such that when removed, it will return to a planar disposition. To this extent, the spring member 16 defines a substantially planar configuration. A first side 18 of the spring member 16 defines a substantially linear edge for engaging a side or top of the notebook computer screen 12. The spring member 16 defines a pair of outer tabs 20, with one each being disposed at either end of the spring member first side 18. A central tab 22 is defined by the spring member 16 at the central portion and on the first side 18 thereof. Each of the outer tabs 20 and the central tab 22 extend away from the spring member first side 18 in a substantially parallel fashion, and coplanar to the spring member 16. To this extent, it is preferable that the spring member 16, outer tabs 20 and central tab 22 are integrally formed. As best illustrated in FIGS. 4 and 5, the spring member 16 is bendable such that the notebook computer screen 12 is received between the outer and central tabs 20,22, with the outer tabs 20 being disposed in front of the screen 12 and the central tab 22 being disposed behind the screen 12. Thus, the spring member 16 acts as a leaf spring.

In the preferred embodiment, the spring member 16 is fabricated from a plastic such as polystyrene and defines a thickness of approximately 0.07 inches. The length of the preferred embodiment is approximately 8.6 inches, with a preferred width of 2.45 inches. The outer tabs 20 are approximately 0.7 inches long and 0.5 inches wide. The central tab 22 is preferably 1.2 inches long and 0.96 inches wide. It will be understood that these dimensions are disclosed as exemplary dimensions only, and are not intended to limit the present invention.

The facia member 24 of the illustrated embodiment defines a substantially elliptical configuration having opposing wings 26,30 extending away from a central tab 34. The facia member 24 is fabricated from a flexible, resilient material similar to the material of fabrication of the spring member 16. The facia member 24 defines a substantially planar configuration. The facia member 24 defines a central tab 34 substantially similar in size to the spring member central tab 22. An upwardly extending wing 26 and a downwardly extending wing 30 are each defined by the facia member 24, each being a substantial mirror image of the other, and each extending away from the central tab 34 as shown. In the illustrated embodiment, the upwardly and downwardly extending wings 26,30 cooperate to define a substantially elliptical configuration. However, it will be understood that other configurations may be employed as well with similar results. As best illustrated in FIG. 4, when the spring member 16 is bent such that the notebook computer screen 12 is received between the outer and central tabs 20,22, the ends 28,32 of the wings 26,30 engage the spring member 16 while the central portion of the facia member 24 is forced away from the central portion of the spring member 16. Thus, the facia member 24 serves as a leaf spring acting in an opposite direction as that of the spring member 16. As a result, when a document 14 is inserted between the spring member 16 and the facia member 24, when the copy clip 10 is disposed on a notebook computer screen 12, the ends 28,32 of the facia member wings 26,30 are biased toward the spring member 16 to hold the document 14 firmly in place. Because the spring member 16 defines a continuous surface corresponding to the facia member 24, it can be seen that the document 14 is forced to remain in engagement with the front surface of the spring member 16, and is therefore left unharmed, as opposed to prior art devices wherein the document 14 does not engage both sides of the device at a corresponding locations and is therefor caused to wrinkle.

In the preferred embodiment, the facia member 24 is fabricated from a plastic such as polystyrene. The central tab 34 of the facia member 24 defines a thickness of approximately 0.06 inches, while the wings 26,30 of the facia member 24 define a thickness of approximately 0.03 inches. This thickness is less than the above-described thickness of the spring member 16, which allows the facia member 24 to define a greater flexibility. Further, the reduced thickness of the wings 26,30 creates a gap between the spring member 16 and the facia member 24 for the receipt of documents 14 to be mounted on the notebook computer screen 12. The length of the preferred embodiment is approximately 6.0 inches, with a preferred width of 0.8 inches. The central tab 34 is preferably 1.2 inches long and 0.96 inches wide. As in the instance of the spring member 16, it will be understood that these dimensions are disclosed as exemplary dimensions only, and are not intended to limit the present invention.

Figure 3:
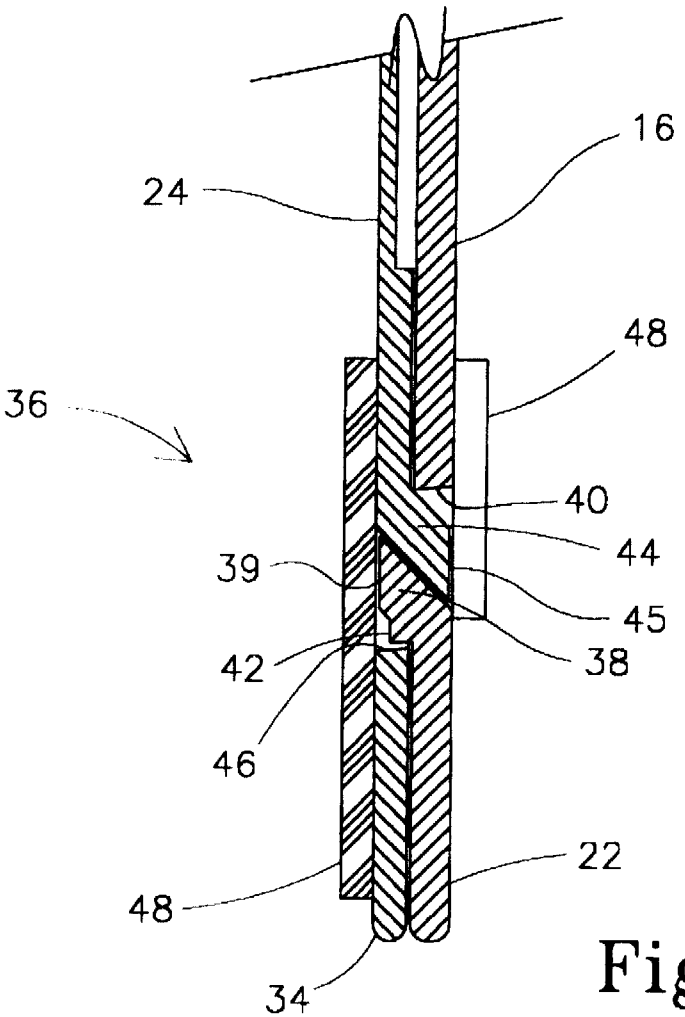
FIG. 3 is an end view, in section, of the notebook computer copy clip taken along 3—3 of FIG. 1.

In order to secure the facia member 24 to the spring member 16, an engagement device 36 is provided. As best shown in FIG. 3, in the illustrated embodiment, cooperating engagement tabs 38,44 and tab receptors 40,46 are defined by the spring member 16 and the facia member 24 such that the spring member 16 and facia member 24 may be loosely secured one to the other. The spring member 16 defines an engagement tab 38 extending upwardly at an angle of approximately forty five degrees (45°). The engagement tab 38 defines an end 39 substantially parallel to the spring member 16 and a distance away from the spring member 16 approximately equal to the thickness of the facia member 24. The facia member 24 defines an engagement tab 44 similar to that of the spring member engagement tab 38, with a reverse orientation. The distance of the facia member engagement tab end 45 from the facia member 24 is approximately equal to the thickness of the spring member 16. Immediately above the spring member engagement tab 38 is defined a tab receptor 40 dimensioned to receive the facia member engagement tab 44. Likewise, immediately below the facia member engagement tab 44 is defined a tab receptor 46 dimensioned to receive the spring member engagement tab 38. Thus, the spring member 16 and the facia member 24 may be placed in engagement one with the other by inserting the engagement tab 38,44 of each into the corresponding tab receptor 40,46 defined by the other. In order to lock the engagement of the facia member 24 with the spring member 16, the spring member 16 defines a locking member 42 below the engagement tab 38 thereof for engaging the lower extent of the facia member tab receptor 46. The lower end of the locking member 42 defines a slight slope upward (approximately one degree (1°)) in order to assist in snapping the facia member 24 into engagement with the spring member 16.

In order to provide a gripping surface, and further in order to prevent damage to the notebook computer housing, cushions 48 are carried on the outer tabs 20 of the spring member 16 and the central tab 22 of the facia member 24, as best illustrated in FIG. 1. A preferred material of fabrication of such cushions 48 is neoprene. However, any other suitable material may be used as well. Each cushion 48 is dimensioned and placed to protect each point of engagement of the copy clip 10 with the notebook computer. The cushions 48 carried by each of the outer tabs 20 are preferably wrapped around the inside edge thereof to engage both sides of the respective outer tab 48.

Limits 50 are provided as registration and alignment guides for the installation of the cushions 48 on the outer tabs 20. After installation of the cushions 48, the limits 50 serve as registration and alignment guides for documents 14 placed within the copy clip 10. Each limit 50 is a raised portion defined by the spring member 16 at each end of the first side 18 thereof.

Figure 6:
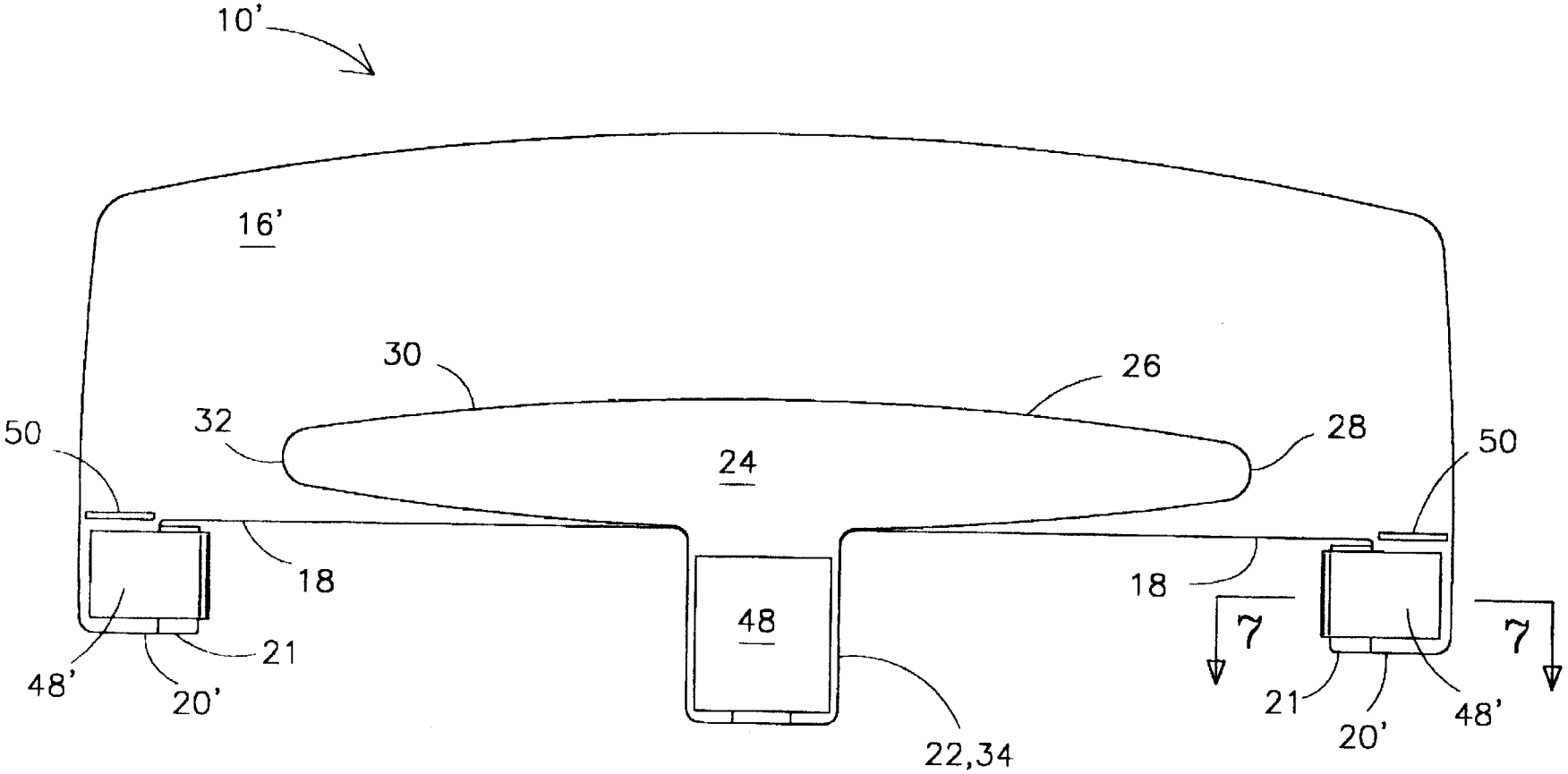
FIG. 6 is a front elevation view of an alternate embodiment of the notebook computer copy clip constructed in accordance with several features of the present invention.
Figure 8:
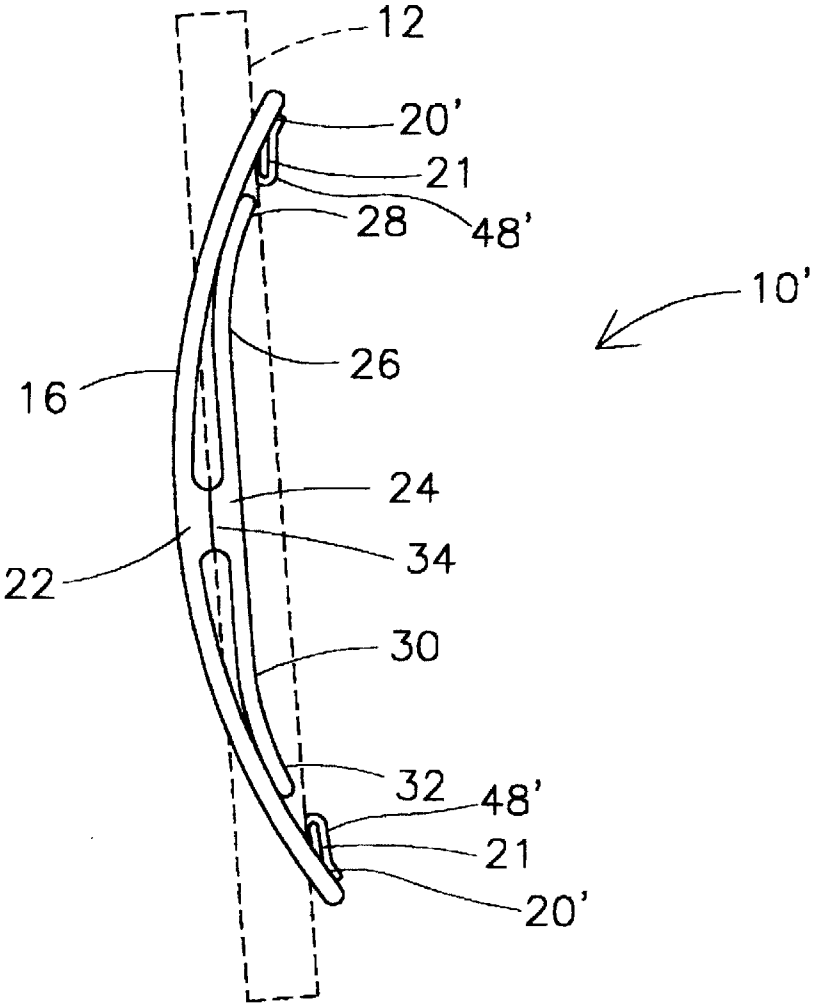
FIG. 8 illustrates an end elevation view of the notebook computer copy clip of FIG. 6 shown being carried on the screen of a notebook computer.
Figure 7:
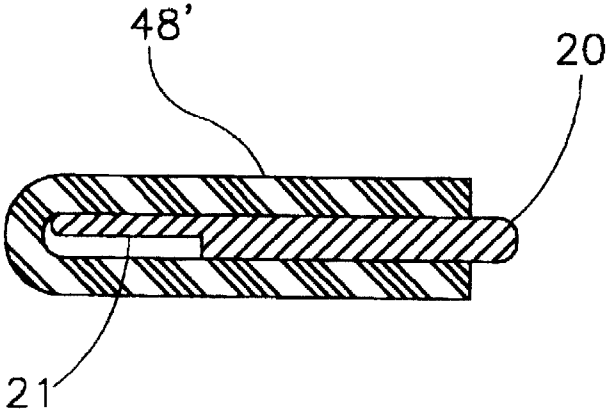
FIG. 7 is a cross-sectional view of an outer tab of the notebook computer clip taken at 7—7 of FIG. 6.

FIGS. 6–8 illustrate an alternate embodiment of a copy clip 10'. Elements identical to the previously described embodiment are labelled with identical numbers. Other elements are labelled with numerals corresponding to similar elements in the previous embodiment followed with the symbol "'". In the alternate embodiment, each of the outer tabs 20' defines an extended portion 21 extending toward the central tab 22. As best illustrated in FIG. 8, the extension members 21 provide a greater contact surface between the copy clip 10' and the notebook computer screen 12. Thus, a tighter grip is achieved and the copy clip 10' is better retained on the notebook computer screen 12. In order to allow for greater flexibility of the extension members 21, the extension members 21 define a lesser thickness than that of the spring member 16'.

From the foregoing description, it will be recognized by those skilled in the art that a notebook computer copy clip offering advantages over the prior art has been provided. Specifically, the notebook computer copy clip provides a means for holding a document or group of documents in relation to a notebook computer screen for viewing while typing. The copy clip of the present invention may be removed after use such that the notebook computer is not damaged, and such that the copy clip may be easily transported. The copy clip provides a means whereby copy may be held with respect to either side or the top of the notebook computer screen. Although the present invention is described as being used with a notebook computer, it will be understood that such device may also be used on any other substantially flat surface, such as a book shelve, piece of glass, or the like.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention,

I claim:

1. A notebook computer copy clip for holding at least one document relative to a notebook computer screen, said notebook computer copy clip being releasably mountable on either side or the top of the notebook computer screen, said notebook computer copy clip comprising:

a spring member defining a substantially planar configuration and being fabricated from a flexible, resilient material, said spring member defining a first side having a substantially linear configuration, a pair of outer tabs, one each being disposed at each end of said first side, and a central tab disposed at a central portion of said first side, said spring member being flexible such as to be mounted on the notebook computer screen, said pair of outer tabs engaging a front surface of the notebook computer screen and said central tab engaging a rear surface of the notebook computer screen when said spring member is mounted on the notebook computer screen;

a facia member defining a substantially planar configuration and being fabricated from said flexible, resilient material, said facia member defining an upwardly extending wing and a downwardly extending wing and a central tab extending therefrom and corresponding to said spring member central tab, an end of each of said upwardly and downwardly extending wings engaging said spring member and said facia member central tab being biased away from said spring member when said spring member is mounted on the notebook computer screen; and an engagement device for securing said facia member to said spring member proximate said spring member central tab and said facia member central tab.

2. The notebook computer copy clip of claim 1 wherein said engagement device includes an engagement tab, a tab receptor, and a locking member defined by said spring member, and an engagement tab and a tab receptor defined by said facia member, said spring member engagement tab, said spring member tab receptor, and said spring member locking device being defined on said spring member central tab, said facia member engagement tab and said facia member tab receptor being defined on said facia member central tab, said spring member engagement tab being configured to be received within said facia member tab receptor, and said facia member engagement tab being configured to be received within said spring member tab receptor, said spring member locking device being configured to be received within said facia member tab receptor in order to prevent disengagement of said facia member from said spring member.

3. The notebook computer copy clip of claim 1 further comprising a plurality of cushions, one each of said plurality of cushions being carried by said pair of spring member outer tabs and said facia member central tab such that said plurality of cushions is disposed between said copy clip and the notebook computer screen when said copy clip is mounted thereon, thereby providing a gripping surface for assisting in maintaining a disposition of said copy clip on the notebook computer screen.

4. The notebook computer copy clip of claim 3 wherein said spring member defines at least one limit proximate said first side, said limit defining a raised portion for registering and aligning said plurality of cushions carried by said pair of spring member outer tabs, and further for engaging an edge of any documents held by said copy clip, thereby limiting movement of the documents toward the notebook computer screen and further assisting in aligning the documents.

5. The notebook computer copy clip of claim 4 wherein said spring member defines one said limit at each end of said first side.

6. A notebook computer copy clip for holding at least one document relative to a notebook computer screen, said notebook computer copy clip being releasably mountable on either side or the top of the notebook computer screen, said notebook computer copy clip comprising:

a spring member defining a substantially planar configuration and being fabricated from a flexible, resilient material, said spring member defining a first side having a substantially linear configuration, a pair of outer tabs, one each being disposed at each end of said first side, and a central tab disposed at a central portion of said first side, said spring member being flexible such as to be mounted on the notebook computer screen, said pair of outer tabs engaging a front surface of the notebook computer screen and said central tab engaging a rear surface of the notebook computer screen when said spring member is mounted on the notebook computer screen;

a facia member defining a substantially planar configuration and being fabricated from said flexible, resilient material, said facia member defining an upwardly extending wing and a downwardly extending wing and a central tab extending therefrom and corresponding to said spring member central tab, an end of each of said upwardly and downwardly extending wings engaging said spring member and said facia member central tab being biased away from said spring member when said spring member is mounted on the notebook computer screen;

an engagement device for securing said facia member to said spring member proximate said spring member central tab and said facia member central tab, said engagement device including an engagement tab, a tab receptor, and a locking member defined by said spring member, and an engagement tab and a tab receptor defined by said facia member, said spring member engagement tab, said spring member tab receptor, and said spring member locking device being defined on said spring member central tab, said facia member engagement tab and said facia member tab receptor being defined on said facia member central tab, said spring member engagement tab being configured to be received within said facia member tab receptor, and said facia member engagement tab being configured to be received within said spring member tab receptor, said spring member locking device being configured to be received within said facia member tab receptor in order to prevent disengagement of said facia member from said spring member; and a plurality of cushions, one each of said plurality of cushions being carried by said pair of spring member outer tabs and said facia member central tab such that said plurality of cushions is disposed between said copy clip and the notebook computer screen when said copy clip is mounted thereon, thereby providing a gripping surface for assisting in maintaining a disposition of said copy clip on the notebook computer screen.

7. The notebook computer copy clip of claim 6 wherein said spring member defines at least one limit proximate said first side, said limit defining a raised portion for registering and aligning said plurality of cushions carried by said pair of spring member outer tabs, and further for engaging an edge of any documents held by said copy clip, thereby limiting movement of the documents toward the notebook computer screen and further assisting in aligning the documents.

8. The notebook computer copy clip of claim 7 wherein said spring member defines one said limit at each end of said first side.

9. A notebook computer copy clip for holding at least one document relative to a notebook computer screen, said notebook computer copy clip being releasably mountable on either side or the top of the notebook computer screen, said notebook computer copy clip comprising:

a spring member defining a substantially planar configuration and being fabricated from a flexible, resilient material, said spring member defining a first side having a substantially linear configuration, a pair of outer tabs, one each being disposed at each end of said first side, and a central tab disposed at a central portion of said first side, said spring member being flexible such as to be mounted on the notebook computer screen, said pair of outer tabs engaging a front surface of the notebook computer screen and said central tab engaging a rear surface of the notebook computer screen when said spring member is mounted on the notebook computer screen;

a facia member defining a substantially planar configuration and being fabricated from said flexible, resilient material, said facia member defining an upwardly extending wing and a downwardly extending wing and a central tab extending therefrom and corresponding to said spring member central tab, an end of each of said upwardly and downwardly extending wings engaging said spring member and said facia member central tab being biased away from said spring member when said spring member is mounted on the notebook computer screen;

an engagement device for securing said facia member to said spring member proximate said spring member central tab and said facia member central tab, said engagement device including an engagement tab, a tab receptor, and a locking member defined by said spring member, and an engagement tab and a tab receptor defined by said facia member, said spring member engagement tab, said spring member tab receptor, and said spring member locking device being defined on said spring member central tab, said facia member engagement tab and said facia member tab receptor being defined on said facia member central tab, said spring member engagement tab being configured to be received within said facia member tab receptor, and said facia member engagement tab being configured to be received within said spring member tab receptor, said spring member locking device being configured to be received within said facia member tab receptor in order to prevent disengagement of said facia member from said spring member; and at least one limit defined by said spring member proximate said first side, said limit defining a raised portion for engaging an edge of any documents held by said copy clip, thereby limiting movement of the documents toward the notebook computer screen and further assisting in aligning the documents.

10. The notebook computer copy clip of claim 9 further comprising a plurality of cushions, one each of said plurality of cushions being carried by said pair of spring member outer tabs and said facia member central tab such that said plurality of cushions is disposed between said copy clip and the notebook computer screen when said copy clip is mounted thereon, thereby providing a gripping surface for assisting in maintaining a disposition of said copy clip on the notebook computer screen.

11. The notebook computer copy clip of claim 10 wherein said spring member defines one said limit at each end of said first side, and wherein each said limit is provided for registering and aligning said plurality of cushions carried by said pair of spring member outer tabs.

* * * * *